US007798366B2

(12) United States Patent
Hoshino

(10) Patent No.: US 7,798,366 B2
(45) Date of Patent: Sep. 21, 2010

(54) TWO-LIQUID DISTRIBUTING AEROSOL DEVICE

(75) Inventor: Kazunori Hoshino, Zushi (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 1023 days.

(21) Appl. No.: 10/543,437

(22) PCT Filed: Jan. 22, 2004

(86) PCT No.: PCT/JP2004/000544

§ 371 (c)(1),
(2), (4) Date: Aug. 26, 2005

(87) PCT Pub. No.: WO2004/076312

PCT Pub. Date: Sep. 10, 2004

(65) Prior Publication Data

US 2006/0049278 A1 Mar. 9, 2006

(30) Foreign Application Priority Data

Jan. 24, 2003 (JP) ..... 2003-016758
Jan. 19, 2004 (JP) ..... 2004-010207

(51) Int. Cl.
*B65D 83/14* (2006.01)

(52) U.S. Cl. ..... 222/136; 222/94; 222/402.24; 222/105; 239/333

(58) Field of Classification Search ..... 222/136, 222/137, 94, 386.5, 389, 635, 95, 105, 402.1, 222/402.24; 239/306–308, 333
See application file for complete search history.

(56) References Cited

U.S. PATENT DOCUMENTS

| | | | | |
|---|---|---|---|---|
| 3,693,837 | A * | 9/1972 | Yuhas | 222/94 |
| 3,982,668 | A * | 9/1976 | Riccio | 222/95 |
| 5,901,883 | A * | 5/1999 | Ritsche | 222/137 |

FOREIGN PATENT DOCUMENTS

| | | |
|---|---|---|
| JP | 47-11809 | 10/1972 |
| JP | 49-89914 | 8/1974 |
| JP | 50-37113 | 4/1975 |
| JP | 54-2213 | 1/1979 |
| JP | 63-91473 | 6/1988 |
| JP | 6-336272 | 12/1994 |
| JP | 2002-204989 | 7/2002 |
| WO | WO-01/89956 | 11/2001 |

* cited by examiner

*Primary Examiner*—J. Casimer Jacyna
(74) *Attorney, Agent, or Firm*—Jordan and Hamburg LLP

(57) ABSTRACT

Provided is a two-liquid distributing aerosol device separately storing two types of liquids to be separately stored, wherein the two types of liquids are separately distributed in a valve mechanism and mixed for use immediately before distribution or separately distributed for use without mixing. The device having first and second passages, formed separately from each other, each passage having an independent seal.

7 Claims, 11 Drawing Sheets

TWO-LIQUID DISTRIBUTING AEROSOL DEVICE

TECHNICAL FIELD

This invention relates to an aerosol device for distributing a plurality of liquids, and has an object to enable aerosol products containing the plurality of liquids, such as, e.g., hot shaving cream, hair dye, adhesive, or the like, to be used upon previously separating as storing the plurality of liquids in advance, in a condition where the plurality of liquids are to be introduced separately without mixed inside a valve mechanism such as, e.g., a housing, a stem, or the like, and subsequently mixed immediately before ejected, or to be distributed in a separated state without mixed, wherein the aerosol products may cause, if the liquids are mixed beforehand, undesirable chemical reaction such as, e.g., hardening, oxidation, or the like.

BACKGROUND ART

Conventionally, there has existed a two-liquid distributing aerosol device in which a first liquid and a second liquid different from the first liquid are filled separately in an aerosol container and injected after mixed at once. On the two-liquid distributing aerosol devices of this type, such as disclosed in Unexamined Utility Model Publication, No. Showa 47-11,809, a first liquid in a first internal bag and a second liquid in a second internal bag are sealed with the same seal member, while being released to an exterior of the container after mixed inside the same valve mechanism. As described above, where the first and second liquids are mixed inside the same valve mechanism, a mixture of the first and second liquids remains inside the valve mechanism such as, e.g., a housing or the like, even after the first and second liquids are completed to be injected.

Where the first and second liquids have a relation as a base agent and a hardening agent, the remaining liquid hardens inside the valve mechanism, thereby causing a clogged or non-injectable condition. Furthermore, where the first liquid and second liquids are, likewise hair dye, defined as a base agent and an oxidizing agent, the remaining oxidized liquid remains inside the valve mechanism to get deteriorated during a period up to subsequent injection. It is undesirable since this deteriorated remaining liquid is injected and attached to an objective portion at the next time of injection.

With intent to prevent the remaining liquid from getting hardened or deteriorated, there has existed such a device as disclosed in Unexamined Utility Model Publication, No. Showa 63-91,473 and Unexamined Patent Publication, No Heisei 06-336,272, in which each of valve mechanisms is separately connected to a first internal bag and a second internal bag. With the device of this type, since each of the internal bags has different valve mechanism, the first and second liquid are prevented from mixed, however, in a case where two valve mechanisms are pressed with single push button, both stems of two valve mechanisms are difficult to be equally pressed, so that one of valve mechanisms is opened earlier than the other in many cases. Where two valve mechanisms are not opened at the same time, either the first liquid or the second liquid is ejected earlier, so that it becomes difficult to mix or eject both liquids equally.

Furthermore, there has existed such as shown in FIG. 5 to FIG. 8 disclosed in Unexamined Patent Publication, No. Showa 49-89,914, a first passage and a second passage respectively communicable with a first internal bag and a second internal bag are formed up to an upper end of a stem, and a first liquid and a second liquid are ejected upon separated without mixed up to the upper end of the stem while a single valve mechanism controls this ejection of the first and second liquid. This invention aims to eject the first and second liquids upon separated up to the upper end of the stem without mixed as well as to inject the first and second liquids with the single valve mechanism at the same time.

However, the valve mechanism such as described in Unexamined Patent Publication, No. Showa 49-89,914, controls sealing of the first and second passages respectively communicable with the first and second internal bags, with a single seal member composed of a stem gasket. Therefore, when rendering the first and second passages communicate respectively with the first and second internal bags upon pressing and moving the stem, since there is only one seal member, the first passage is communicated not only with the first internal bag but with the second internal bag while the second passage is communicated not only with the second internal bag but with the first internal bag, even for a short period. As a result, the first and second liquids are mixed with each other near the seal member, and thus this mixture of the first and second liquid remains inside the valve mechanism after the first and second liquid are completed to be injected, so that this invention is defective in a point that the remaining liquid gets hardened and deteriorated.

DISCLOSURE OF THE INVENTION

To solve the aforementioned problems, this invention enables aerosol products containing two liquids, such as, e.g., hot shaving cream, hair dye, adhesive, or the like, to be used upon previously separating as storing the two liquids, i.e., a base agent and an additive agent, in a condition where the two liquids are to be introduced separately without mixed inside a valve mechanism such as, e.g., a housing, a stem, or the like, and subsequently mixed immediately before ejected, or are to be distributed in a separated state without mixed, wherein the aerosol products may cause, if the liquids are mixed beforehand, undesirable chemical reaction such as, e.g., hardening, oxidation, or the like. Therefore, the remaining mixture of the two liquids does not exist inside the valve mechanism, so that it becomes possible to prevent defective operation due to the hardened remaining material or injection of deteriorated remaining material.

For solving the aforementioned problem, the first invention includes: an aerosol container filled with a pressurized gas, and filled with a first liquid and a second liquid different from the first liquid as separated from the first liquid as not in contact with the first liquid; a stem having lower end thereof arranged at the interior of the housing; a first passage disposed at the stem as formed up to a top end of the stem, the first passage connectable to the first liquid; a second passage disposed at the stem as formed up to the top end of the stem as separated from the first passage, the second passage connectable to the second liquid; a first seal member sealing the first liquid and the first passage when the stem is not pressed; and a second seal member sealing communication between the second liquid and the second passage when the stem is not pressed, wherein the first liquid and the second liquid can be distributed, without mixed in a separated state, from the stem, upon releasing the first seal member and the second seal member upon pressing and moving the stem.

The second invention include: the aerosol container filled with pressurized gas, and filled with the second liquid able to be injected to an exterior of the container with pressure of the pressurized gas; an internal bag formed as easily deformed with the pressurized gas, filled with the first liquid different from the second liquid, and arranged inside the second liquid; the stem having lower end thereof arranged at the interior of the housing; the second passage disposed at the stem as formed up to the top end of the stem, the second passage connectable to the second liquid via a dip tube; the first passage disposed at the stem as formed up to the top end of the stem as separated from the second passage, the first passage connectable to the internal bag; the second seal member sealing the second liquid and the second passage when the stem is not pressed; and the first seal member sealing communication between the internal bag and the first passage when the stem is not pressed, wherein the first liquid and the second liquid can be distributed, without mixed in a separated state, from the stem, upon releasing the first seal member and the second seal member upon pressing and moving the stem.

Further, the third invention includes: an aerosol container filled with a pressurized gas; the first internal bag formed as easily deformed with the pressurized gas, filled with the first liquid, and arranged inside the aerosol container; the second internal bag formed as easily deformed with the pressurized gas, filled with the second liquid different from the first liquid, and arranged inside the aerosol container; the stem having lower end thereof arranged at the interior of the housing; the first passage disposed at the stem as formed up to the top end of the stem, the first passage connectable to the first internal bag; the second passage disposed at the stem as formed up to the top end of the stem, the first passage connectable to the first internal bag; the first seal member sealing the first internal bag and the first passage when the stem is not pressed; and the second seal member sealing communication between the second internal bag and the second passage when the stem is not pressed, wherein the first liquid and the second liquid can be distributed, without mixed in a separated state, from the stem, upon releasing the first seal member and the second seal member upon pressing and moving the stem.

The second passage may communicate with the interior of the housing via a stem gasket constituting the second seal member. The communication between the second passage and the housing may be sealed in a state where the stem is not pressed. The second liquid is distributed to the exterior of the container upon communicating the second passage with the housing in association with pressing of the stem. The first passage is formed as penetrating from a side opening to the exterior top end of the stem. The first seal member disposed at an outer circumference of the side opening is rendered in close contact with an inter circumferential surface of the housing, where the stem is not pressed, at an interval between a communicating portion to the first liquid and a communicating portion to the second liquid to intercept the communication between the first liquid and the exterior of the container as well as to distribute the first liquid to the exterior of the container when the stem is pressed, upon connecting in a communicating manner the side opening and the first liquid.

The second seal member in communication with the interior of the housing at all times, disposed at an outer circumference of the stem, may seal the communication between the second passage and the second liquid where the stem is not pressed. The second liquid is communicated with the second passage in association with the pressing of the stem to be distributed to the exterior of the container. The first passage may be formed as penetrating from the side opening to the exterior top end of the stem. The first seal member disposed at the outer circumference of the side opening may be rendered in close contact with the inner circumferential surface of the housing, where the stem is not pressed, at the interval between the communicating portion to the first liquid and the communicating portion to the second liquid to intercept the communication between the first liquid and the exterior of the container as well as to distribute the first liquid to the exterior of the container when the stem is pressed, upon connecting in a communicating manner the side opening and the first liquid.

The second seal member may be disposed at the outer circumference of the stem while arranged above the communicating portion of the second liquid to the second passage, where the stem is not pressed, to seal the communication between the second liquid and the second passage, and is moved up to a portion lower than the second passage in association with the pressing of the stem to distribute the second liquid to the exterior of the container upon flowing the second liquid via the released second passage. The first passage may be formed as penetrating from the side opening to the exterior top end of the stem. The first seal member disposed at the outer circumference of the side opening may be rendered in close contact with the inter circumferential surface of the housing, where the stem is not pressed, at the interval between the communicating portion to the first liquid and the communicating portion to the second liquid to intercept the communication between the first liquid and the exterior of the container as well as to distribute the first liquid to the exterior of the container when the stem is pressed, upon connecting in a communicating manner the side opening and the first liquid.

The stem may be composed of a movable seal member arranged with the second seal member and the first seal member, and a passage member disposed with the second passage and the first passage. The passage member may be detachable from the housing upon separated from the movable seal member. The second seal member may be disposed at the outer circumference of the movable seal member and may be arranged above a second communicating opening where the movable seal member is not pressed, while being moved up to the portion lower than the second communicating opening in association with the pressing of the movable seal member. The first seal member may be rendered in close contact with the inter circumferential surface of the housing, where the stem is not pressed, at the interval between a first communicating opening and the second communicating opening to intercept the communication between the first liquid and the exterior of the container as well as to communicate the side opening with the first liquid in a connectable manner when the movable seal member is pressed.

The passage member may be, when filling an aerosol contents, detached from the housing of the aerosol device having the separately formed movable seal member and the passage member detachable from the housing to insert a filling nozzle into the housing to fill the first liquid or the second liquid upon the pressing of the movable seal member, while the passage member may be inserted into the housing to distribute the first liquid and the second liquid to the exterior of the container.

A filling open valve opened with a filling pressure only when filling the first liquid and the second liquid, may be formed at each of a communicating passage between the second communicating opening and the second liquid and the communicating passage between the first communicating opening and the first liquid. A passing small opening for passing the second liquid and the first liquid when distributing the second liquid and the first liquid, may be formed at the filling open valve.

Further, a top end portion of the stem may have an opening surface level of the first passage and an opening surface level of the second passage different from each other. The first passage may be projected upward from the opening surface of the second passage to prevent the first liquid and the second liquid respectively ejected from the first passage and the second passage from mixed with each other.

This invention enables, since thus structured, aerosol products containing two liquids, i.e., a base agent and a additive agent, previously separated as stored, to be used in a condition where the two liquids are to be distributed separately without mixed inside the valve mechanism such as, e.g., the housing, the stem, or the like, and subsequently mixed immediately before distributed, or are to be distributed in a separated state without mixed, wherein the aerosol products may cause, if the base agent and the additive agent are mixed beforehand, undesirable chemical reaction such as, e.g., hardening, oxidation, or the like. Therefore, the remaining mixture of the two liquids does not exist inside the valve mechanism, so that it becomes possible to prevent defective operation due to the hardened remaining material or injection of deteriorated remaining material.

BEST MODE FOR CARRYING OUT THE INVENTION

Figure 1:
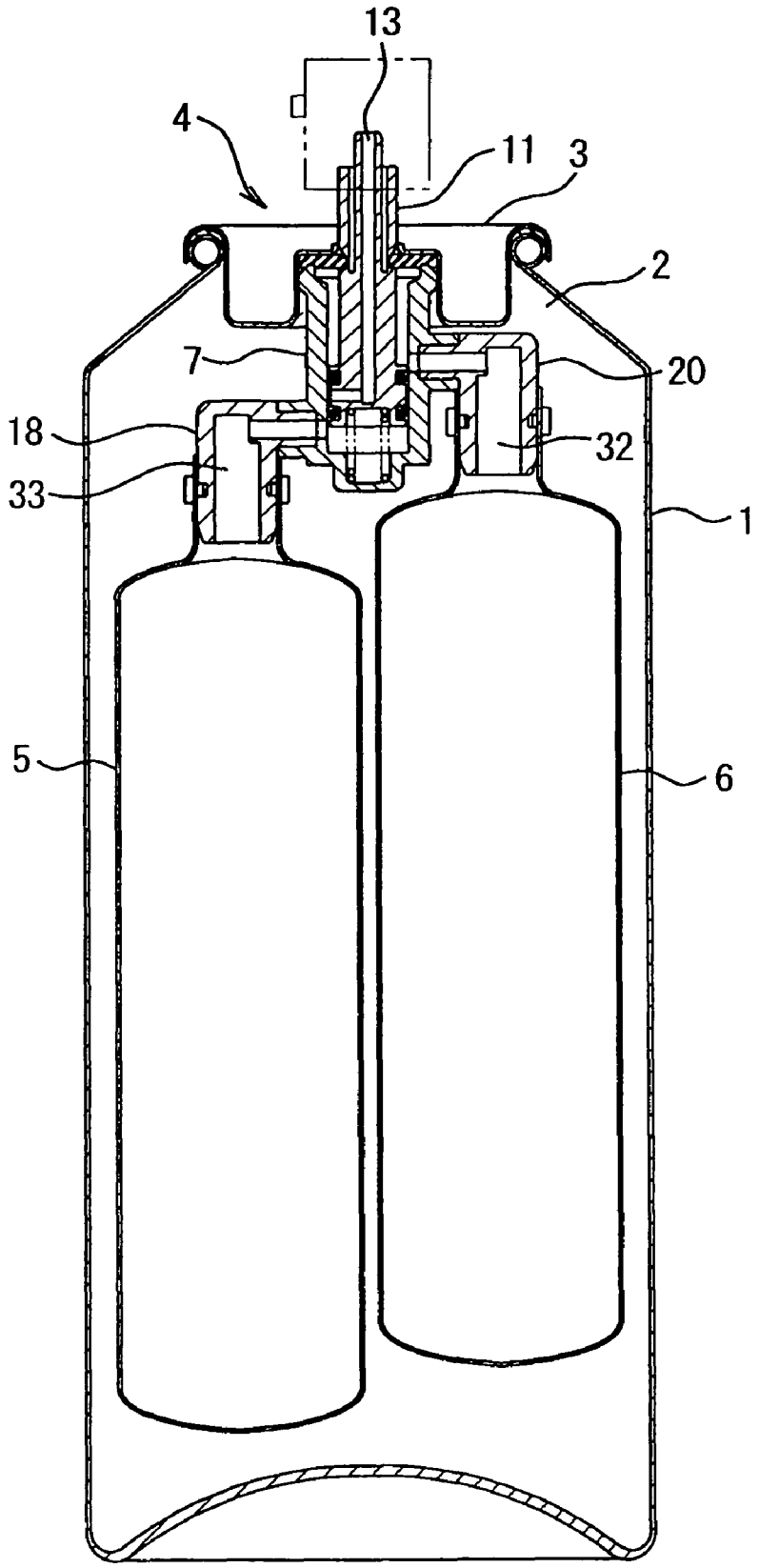
FIG. 1 is a cross-sectional view showing a whole aerosol container having a first internal bag and a second internal bag respectively filled with a first liquid and a second liquid according to the first embodiment.
Figure 2:
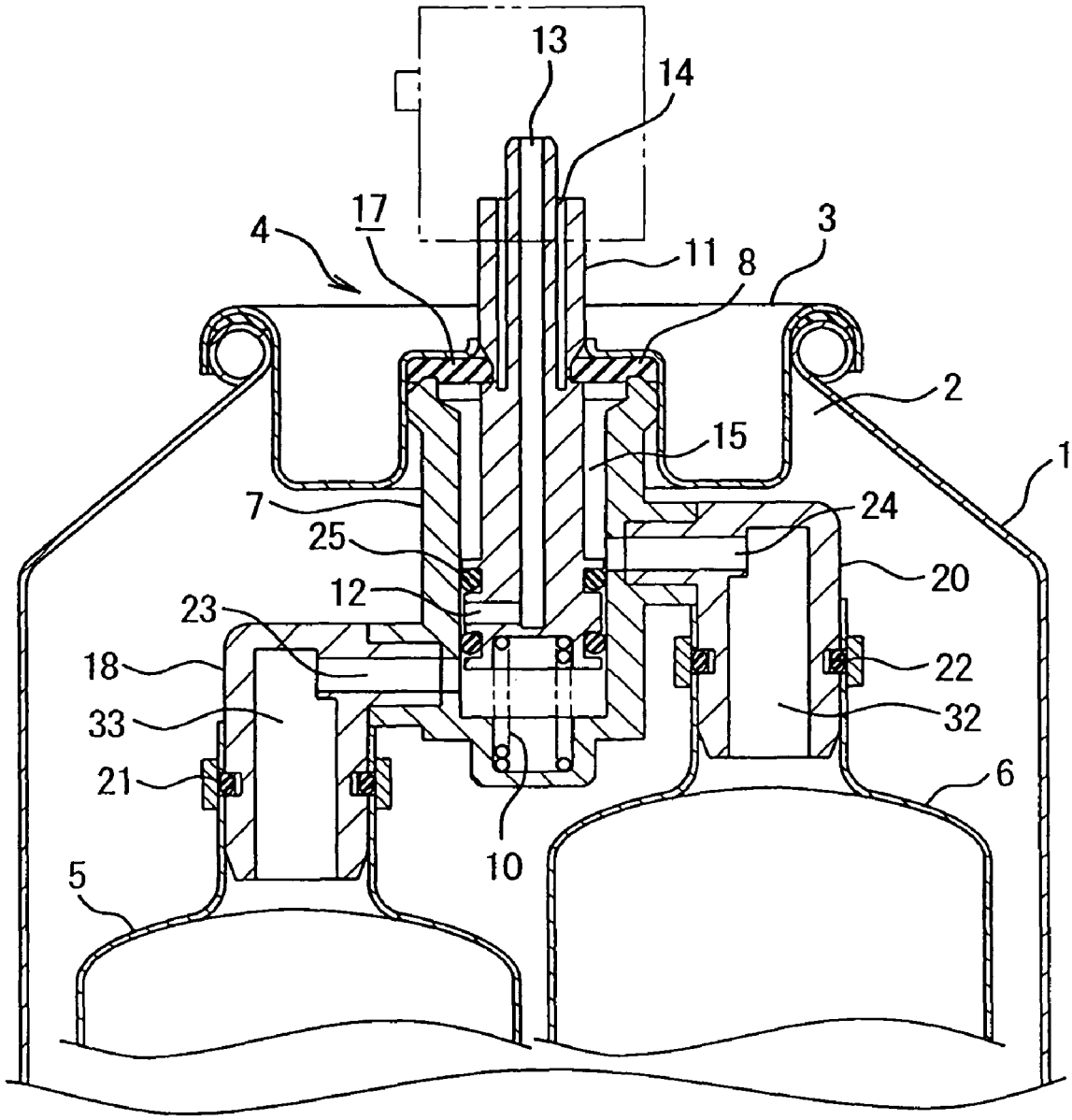
FIG. 2 is an enlarged cross-sectional view showing a portion of a valve mechanism as shown FIG. 1, and showing a state where the first and second liquids are not injected.
Figure 3:
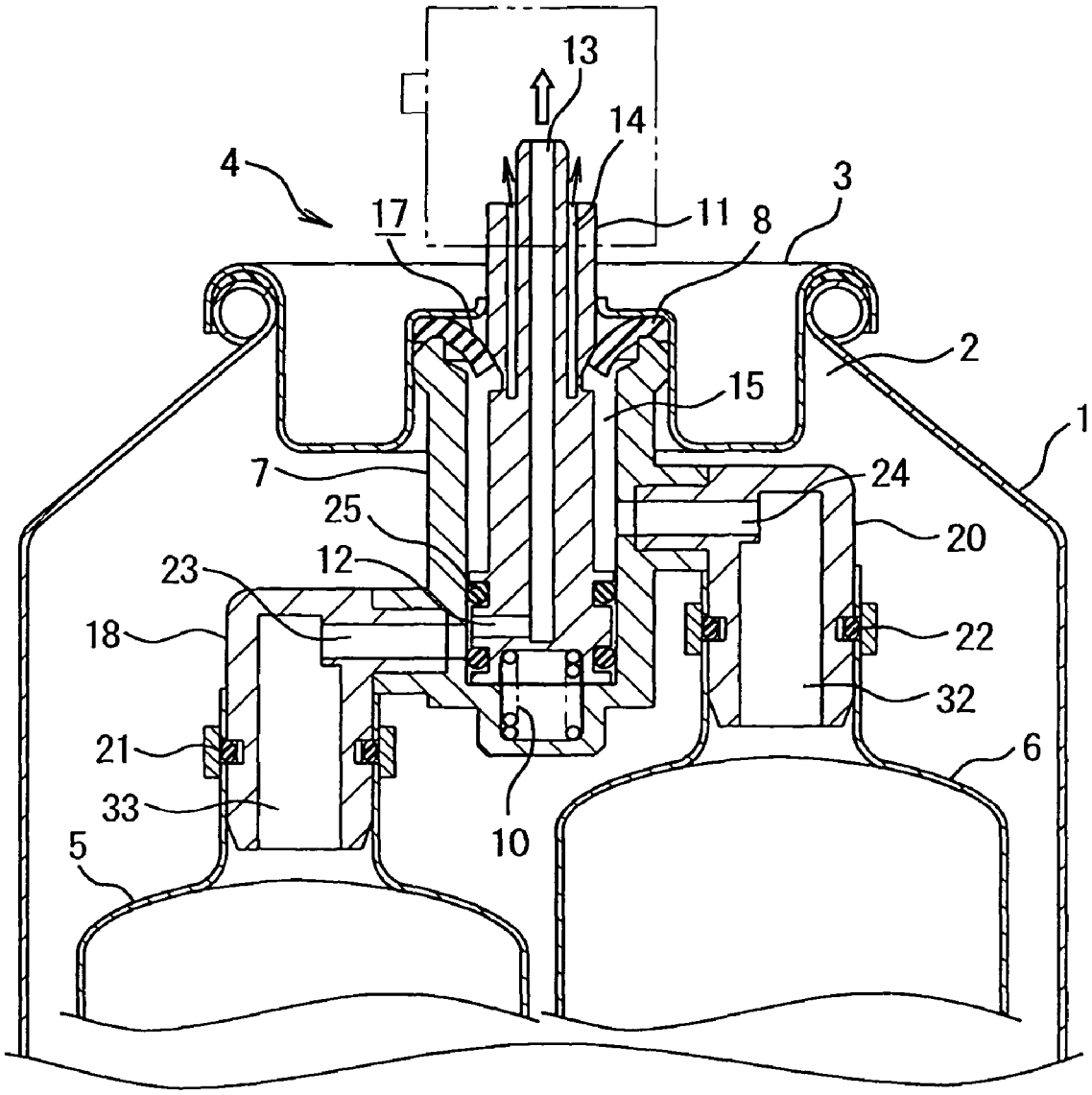
FIG. 3 is an enlarged cross-sectional view showing the portion of the valve mechanism as shown in FIG. 1, and showing a state where the first and second liquids are injected.

First, where the first embodiment is described in reference with FIG. 1, FIG. 2, and FIG. 3, numeral (1) is an aerosol container in which a valve mechanism (4) is arranged at a mountain cup (3) secured to a top end of an opening (2), and pressurized gas such as, e.g., carbon dioxide gas or the like is filled. A first internal bag (5) and a second internal bag (6) formed as easily deformed with pressure of pressurized gas are arranged inside the aerosol container (1). The first internal bag (5) and the second internal bag (6) are formed by such as, e.g., monolayer or multilayer of resin film, aluminum foil, blow bottle, or aluminum tube, or the like, in which the first internal bag (5) is filled with a first liquid and the second internal bag (6) is filled with a second liquid different from the first liquid. The first liquid and the second liquid are in a relation of a base agent and an additive agent, for example, such a combination can be considered, that the second liquid is set to the hardening agent or the oxidizing agent in a case of the first liquid as the base agent.

Further, the first internal bag (5) and the second internal bag (6) are connected to a housing (7) constituting the valve mechanism (4). The housing (7) is secured to an inner surface of the mountain cup (3) via a stem gasket (8). Further, a lower end of a stem (11) urged in an upward direction with a pressing spring (10) is inserted in the housing (7), and a first passage (13) communicating from a side opening (12) opening at a side surface to a top end surface is formed at the stem (11).

Further, in the valve mechanism (4), a second passage (14) allowing the second internal bag (6) and the top end of the stem (11) to be communicated is formed at the stem (11) without communicated with the first passage (13). The second passage (14) is communicated with a flow interval (15) formed at an interval between the outer circumference of the stem (11) and the housing (7), via the stem gasket (8) constituting a second seal member (17). Thus, the second passage (14) is communicated with the interior of the housing (7) only when the stem (11) is pressed.

Furthermore, at the top end of the stem (11) have an opening surface level of the first passage (13) and an opening surface level of the second passage (14) different from each other, and the first passage (13) is projected upward from the opening surface of the second passage (14) to prevent the first liquid and the second liquid respectively ejected from the first passage (13) and the second passage (14) from mixed with each other as well as to prevent easily the first liquid and the second liquid from mixed when filled.

Furthermore, on the side surface of the housing (7), a first connecting member (18) is secured, via a first communicating opening (23), to the position communicable with the first passage (13), while a second connecting member (20) is secured, via a second communicating opening (24), to the portion communicable with the second passage (14). The first connecting member (18) having a lower end thereof formed in a letter L shape is connected airtightly to the first internal bag (5) via a first packing (21) while the second connecting member (20) having a lower end thereof formed in a letter L shape is also connected airtightly to the second internal bag (6) via a second packing (22).

Furthermore, a first seal member (25) is formed with an O-ring at each of a top and a bottom of the side opening (12) of the stem (11) in communication with the first passage (13) to be connected airtightly with the inner circumference surface of the housing (7). In this contacting position, the first seal member (25) is arranged at a middle portion between the first communicating opening (23) of the first connecting member (18) connected to the housing (7) and the second communicating opening (24) of the second connecting member (20) connected to the housing (7) to intercept the communication between the first internal bag (5) and the first passage (13) as well as the communication between the second internal bag (6) and the second passage (14) in a state where the stem (11) is not pressed. In addition, the second internal bag (6) is connected to the interior of the housing (7) at all times, and the stem gasket (8) serving as the second seal member (17) intercepts an interval between the second passage (14) and the interior of the housing (7) when the stem (11) is not pressed.

With the structure as described above, to distribute the first liquid in the first internal bag (5) and the second liquid in the second internal bag (6) without mixed inside the valve mechanism (4), the interior of the housing (7) is moved downward upon pressing the stem (11) as shown in FIG. 3. According to this pressing of the stem (11), the side opening (12) of the first passage (13) is communicated with the first internal bag (5) via the first communicating opening (23) of the first connecting member (18), so that the first liquid is flowed into the first passage (13). Simultaneously, according to the pressing of the stem (11), the interval between the second passage (14) and the interior of the housing, sealed by the stem gasket (8) of the second seal member (17) as shown in FIG. 3, is communicated, so that the second liquid contained in the second internal bag (6) connected to the interior of the housing (7) at all times is flowed into the second passage (14) from the second communicating opening (24) of the second connecting member (2) via the flow interval.

The first and second liquids are introduced without mixed at least up to the top end of the stem (11) since the first passage (13) and the second passage (14) are constituted in a manner not to be communicated with each other in the valve mechanism (4). Furthermore, two liquids can be introduced upon pressing the single stem (11), thereby being able to eject simultaneously two liquids with no or very little time lag, so that two liquids can be distributed with a ratio as designed.

Furthermore, since a member sealing the communication between the first passage (13) and the first internal bag (5) as well as the communication between the second passage (14) and the second internal bag (6), is formed with two members, i.e., the first seal member (25) and the second seal member (17), each seal member can seal the communications independently, thereby not causing the undesirable mixture of two liquids, which is happen when one seal member seals two passages. For example, as shown in FIG. 3, the first seal member (25) seals the communication between the first internal bag (5) and the second internal bag (6) where allowing the communication between the first passage (13) and the first inner bag (5), so that the first passage 13 is communicable only with the first internal bag (5) as shown in FIG. 3. Further, the second passage (14) communicated with the second internal bag (6) controls the communication with the housing (7) by the second seal member (17), so that the first liquid and the second liquid would not be mixed inside the valve mechanism (4).

Figure 4:
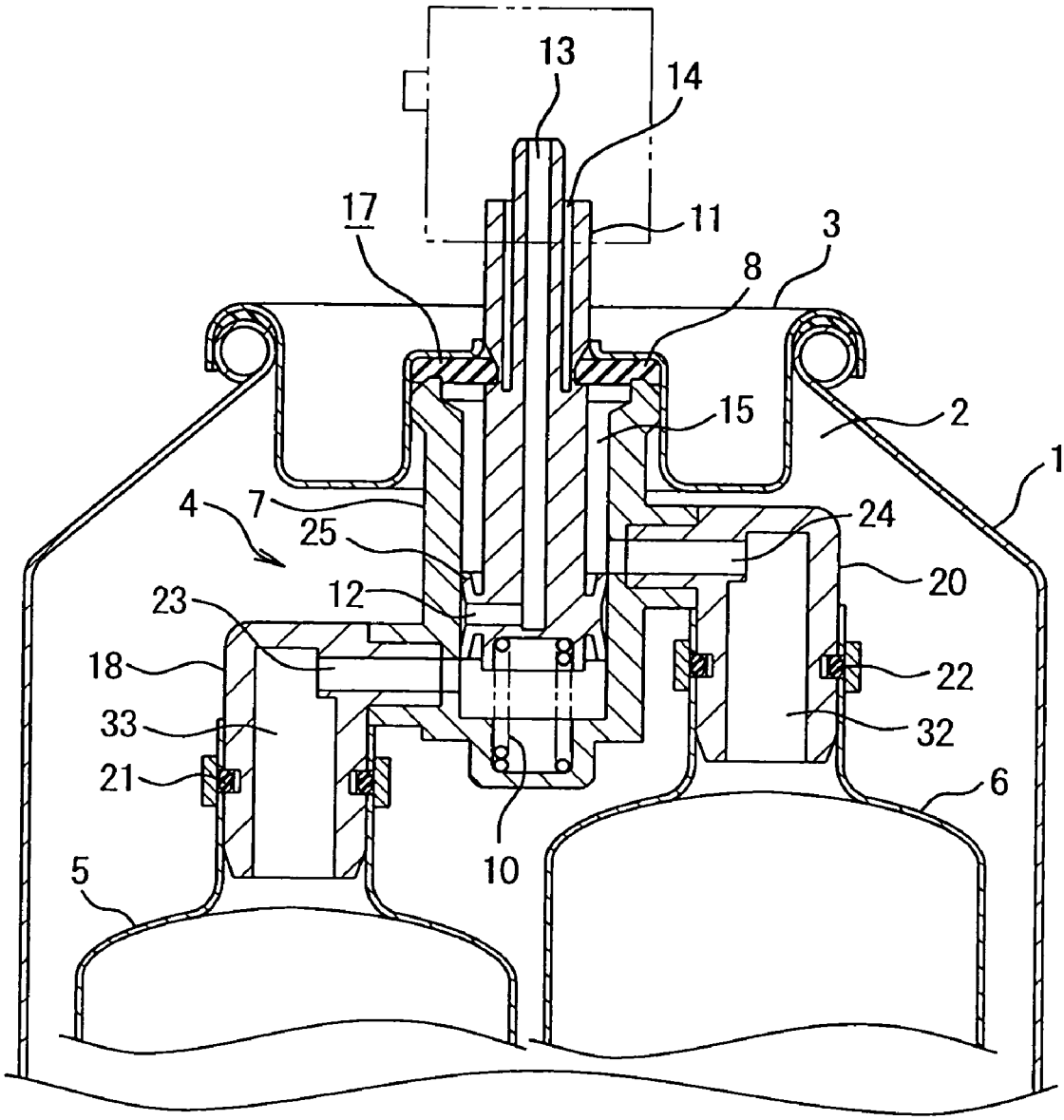
FIG. 4 is a cross-sectional view showing a state where the first and second liquids are not injected according to the second embodiment having a different seal member in the valve mechanism.
Figure 5:
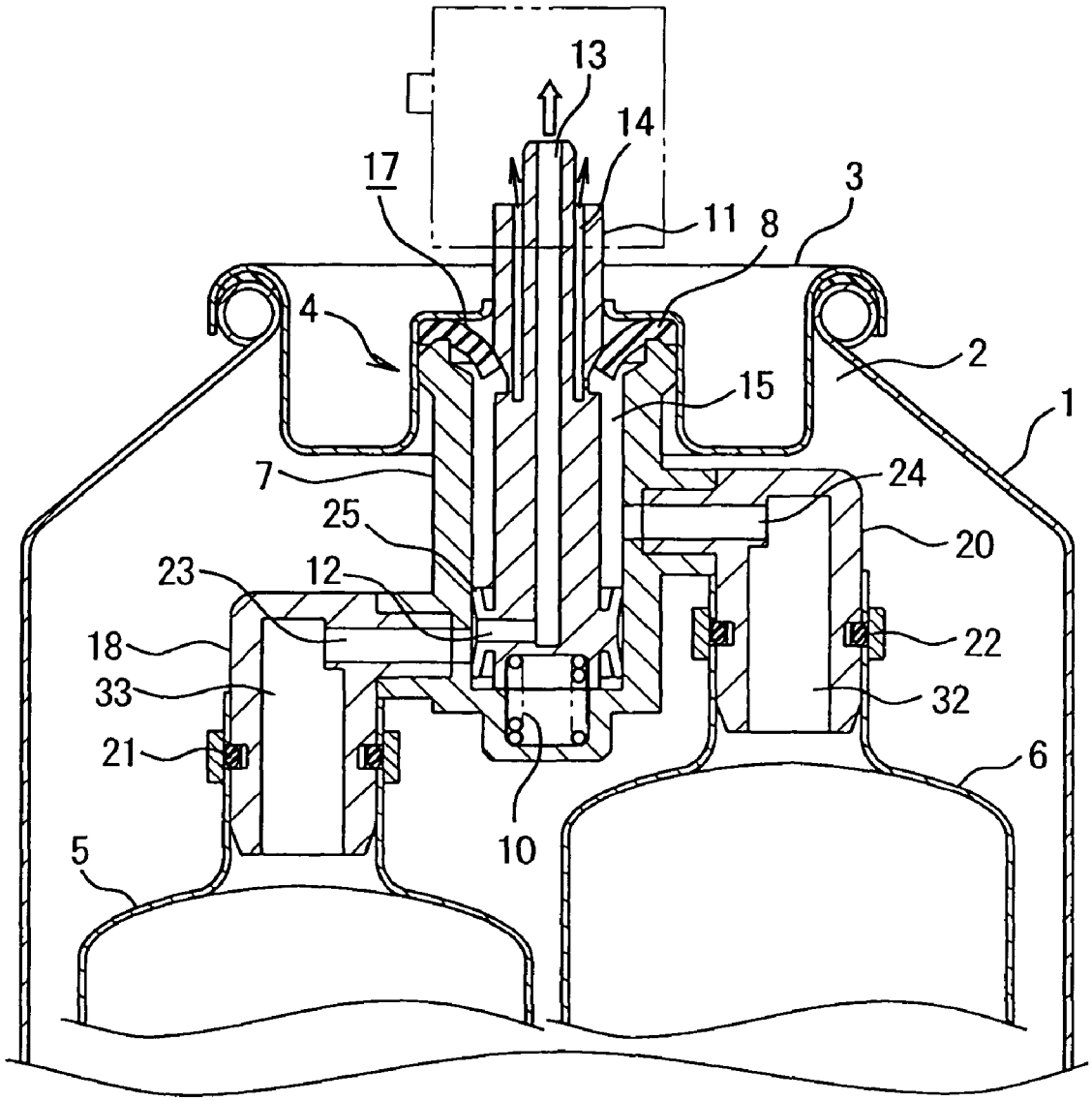
FIG. 5 showing a state where the first and second liquids are injected according to the second embodiment.

Although the first seal member (25) is formed at the outer circumference of the stem (11) upon installed with the O-ring in the first embodiment described above, as shown in FIG. 4 and FIG. 5, the first seal member (25) composed of the packing in a lip shape formed to the outer circumference of the stem (11) as united with the stem, may used in the different second embodiment. In the second embodiment as well, a position at which the first seal member (25) is set, is the same as the above described first embodiment, and the second seal member is the same as the first embodiment.

Figure 6:
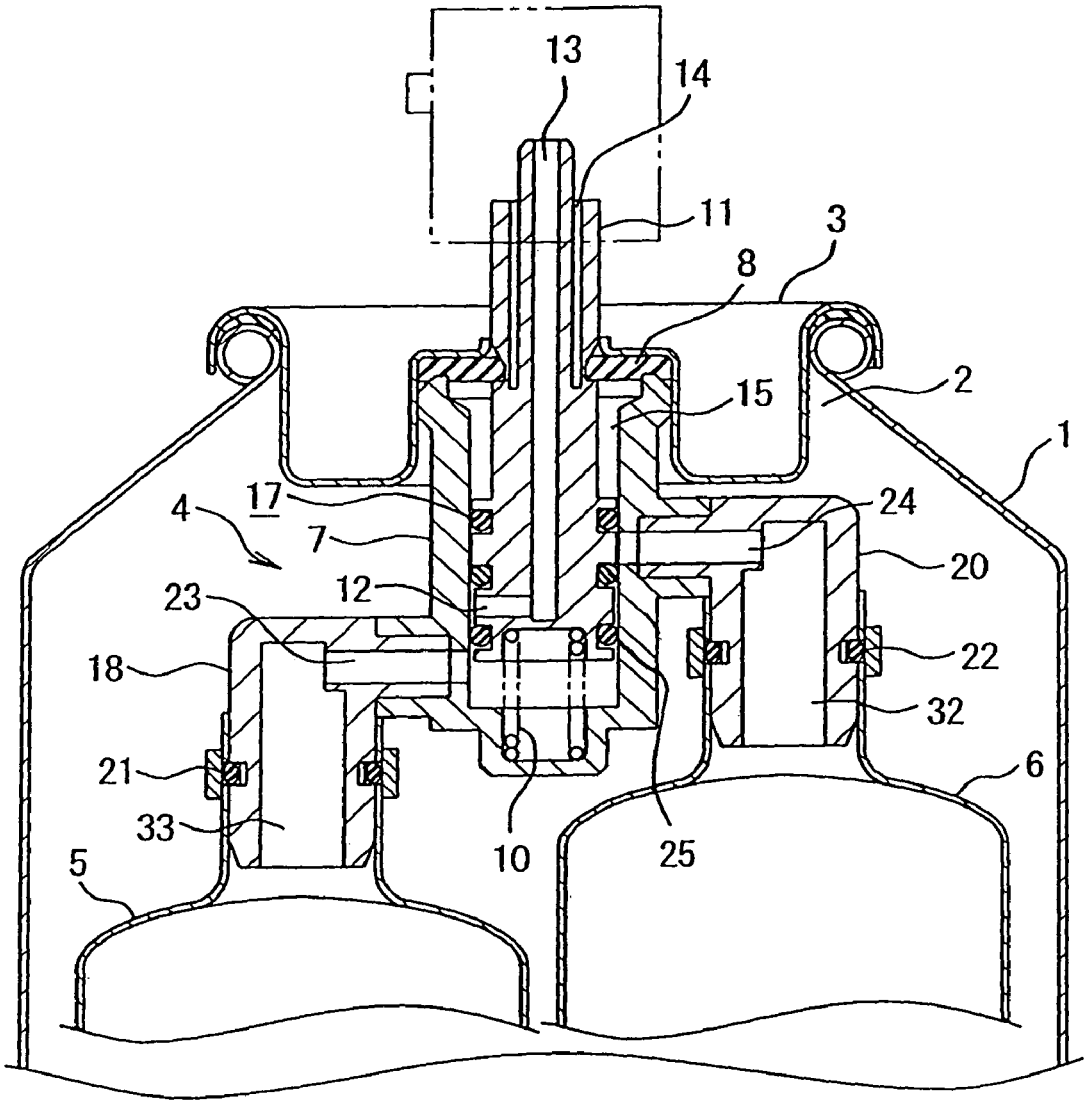
FIG. 6 is a cross-sectional view showing a state where the first and second liquids are not injected according to the third embodiment having an other different seal member in the valve mechanism.
Figure 7:
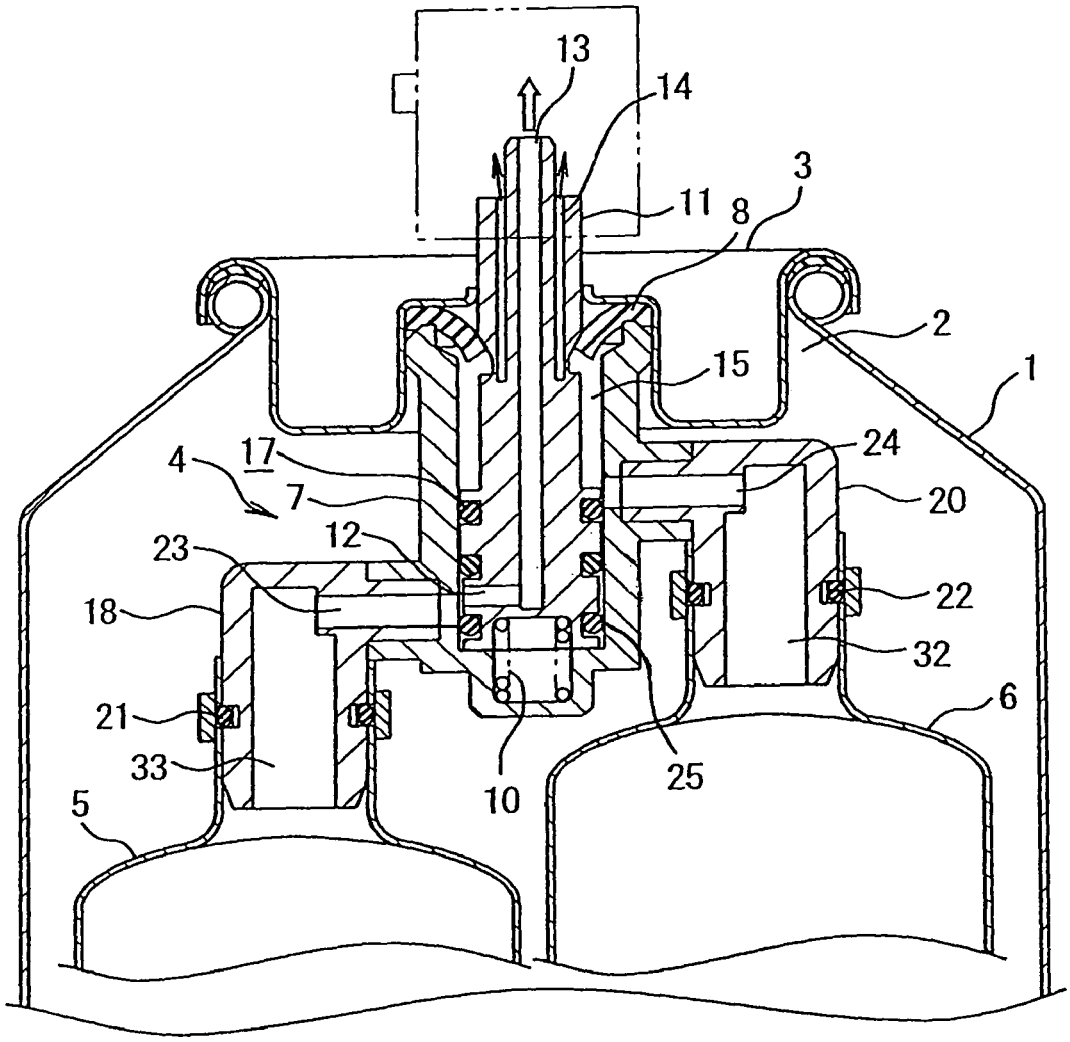
FIG. 7 shows a state where the first and second liquid are injected according to the third embodiment.
Figure 8:
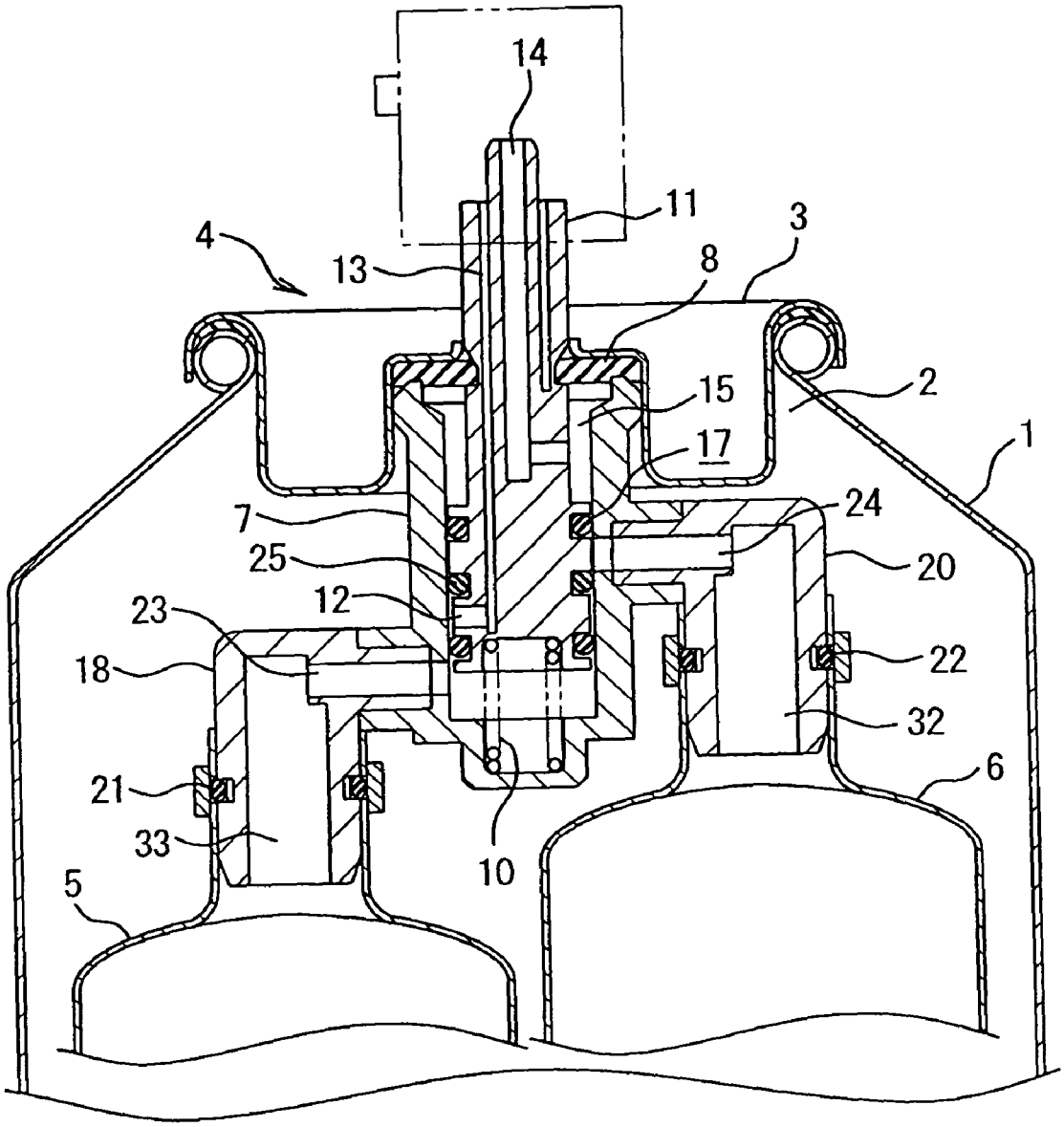
FIG. 8 is a cross-sectional view showing the forth embodiment.

Furthermore, although the second seal member (17) is formed with the stem gasket (8) in the above described first embodiment and the second embodiment, the seal member (17) as shown in FIG. 6 and FIG. 7 is formed with the O-ring in the different third embodiment. The second seal member (17) formed with the O-ring is formed, where the stem (11) is not pressed, to the outer circumference of the stem (11) above the second communicating opening (24) of the second connecting member (20). Furthermore, the first seal member (25) connects, when the stem (11) is pressed, the side opening (12) of the first passage (13) to the first internal bag (5), as described above, however, the second seal member (17) is moved up to a portion lower than the second communicating opening (24) of the second connecting member (20), as shown in FIG. 7, thereby communicating the second internal bag (6) with the second passage (14) via the flow interval (15).

According to the third embodiment, timing for introducing the first liquid to the first passage (13) and timing for introducing the second liquid to the second passage (14) can coincide with each other more precisely than the above described first and second embodiments. That is, the first seal member (25) and the second seal member (17) are formed to one stem (11), thereby being moved at once, so that timing for introducing the first liquid to the first passage (13) and timing for introducing the second liquid to the second passage (14) can coincide with each other certainly. According to the third embodiment in which the first seal member (25) and the second seal member (17) for controlling the first passage (13) and the second passage (14) are formed to the stem (11), the stem gasket (8) becomes unnecessary in terms of controlling the first passage (13) and the second passage (14). However, the stem gasket (8) is effective in terms of securing airtightly the housing (7) to the mountain cup (3), so that the stem gasket (8) is used as a packing in the third embodiment as shown in FIG. 6 and FIG. 7.

Furthermore, the stem gasket (8) seals, where the stem (11) is not pressed, the communication between the second passage (14) and the flow interval (15) of the housing (7) in the above described first, second, and third embodiments, however, in the fourth embodiment, the stem gasket (8) does not seal the above communication, thereby connecting the second passage (14) and the interior of the housing (7) at all times. Furthermore, in the housing (7), the second seal member (17) is formed, where the stem (11) is not pressed, to the outer circumference of the stem (11) above the second communicating opening (24) of the second connecting member (20), to prevent the second liquid from flowing into the second passage (14) upon connected airtightly to the inner surface of the housing (7). Furthermore, when the stem (11) is pressed, the first seal member (25) connects the side opening (12) of the first passage (13) to the first internal bag (5), however, the second seal member (17) is moved up to the portion lower than the second communicating opening (24) of the second connecting member (20) as same as FIG. 7, to communicate the second internal bag (6) with the second passage (14).

In the forth embodiment, the stem gasket (8) is not used as the second seal member (17), so that operation of the first seal member (25) and the second seal member (17) can coincide certainly, and the first and second liquids can be distributed with a value as designated.

Figure 9:
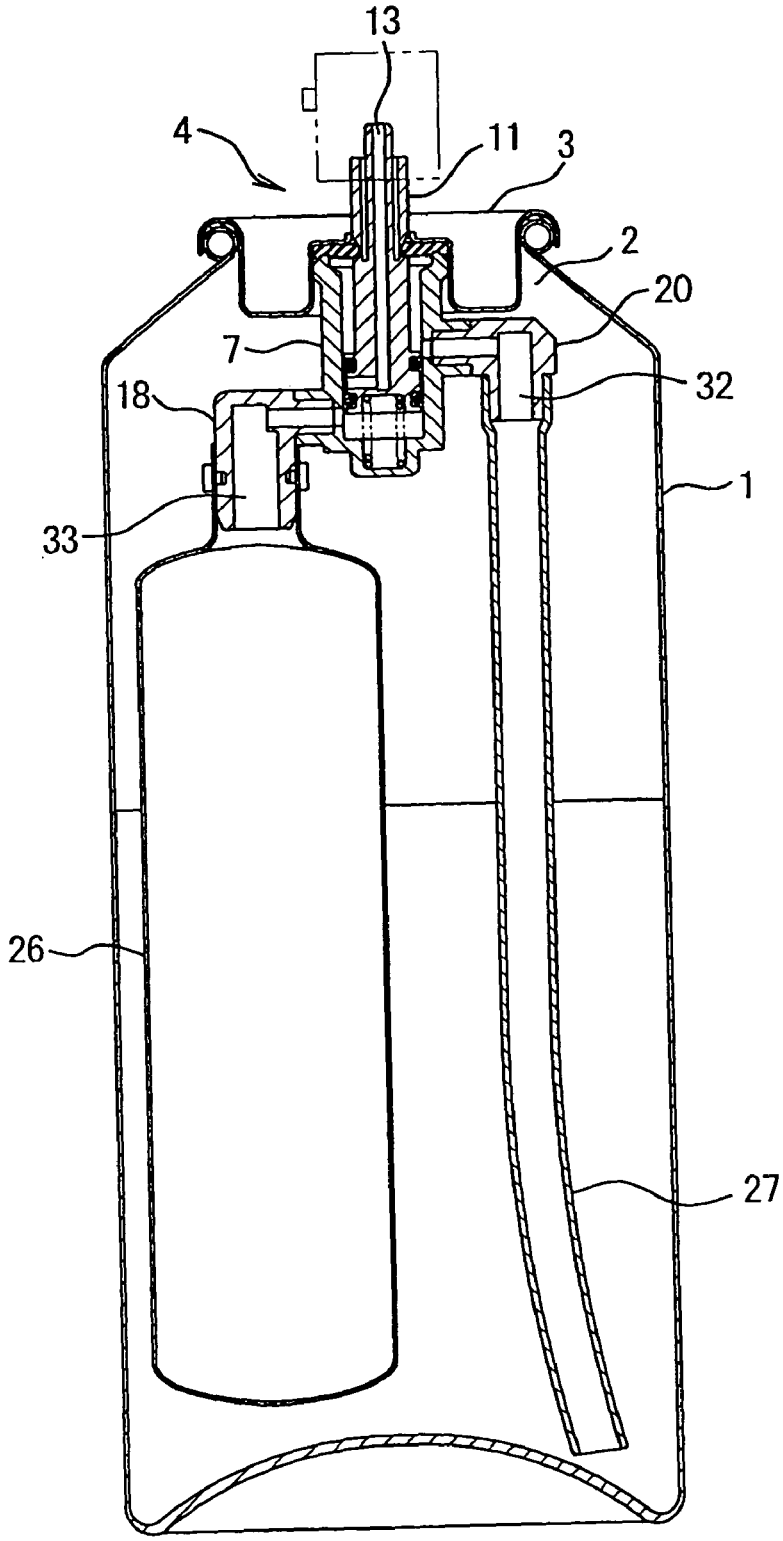
FIG. 9 is a cross-sectional view showing the fifth embodiment defined to have only one internal bag.

In the above described first to forth embodiments, the first and second liquids are separated upon stored respectively in the first internal bag (5) and the second internal bag (6). However, in the different fifth embodiments, as shown in FIG. 9, the second liquid able to be injected to the exterior of the container with pressure of the pressurized gas is directly filled in the aerosol container (1) filled with the pressurized gas, and an internal bag (26) formed as easily deformed with the pressurized gas, filled with the first liquid different from the second liquid, is arranged in the second liquid.

Further, the second liquid is connected to the second passage (14) disposed at the stem (11), via a dip tube (27), while the internal bag (26) is connected to the first passage (13) disposed at the stem (11). The second passage (14) and first passage (13) are formed separately up to the top end of the stem (11) having a lower end thereof arranged inside the housing (7), while the second seal member (17) seals the second liquid and the second passage (14) when the stem (11) is not pressed. In addition, the first seal member (25) disposed at the outer circumference of the stem (11) seals the communication between the internal bag (26) and the first passage (13) when the stem (11) is not pressed, and the first and second seals are released upon pressing and moving of the stem (11), so that the first and second liquids can be distributed in a separated state, without mixed, from the stem (11).

The fifth embodiment is effective in a case, e.g., where the second liquid does not have metal corrosion property, and requires only one internal bag (26), so that such products can be obtained, as having simple structure, manufactured easily, and low priced.

In the above first to fifth embodiments, the stem (11) is formed as united with a portion formed with the first passage (13) and the second passage (14) as well as with a portion formed with the first seal member (25) and the second seal member (17). Likewise this case where the stem (11) is formed as united with the portion formed with the first passage (13) and the second passage (14) as well as with the portion formed with the first seal member (25) and the second seal member (17), the aerosol content is to be injected via the first passage (13) and the second passage (14) when distributing the aerosol content, however, the first passage (13) and the second passage (14) of the stem (11) is to be used when filling the aerosol content into the aerosol container (1).

The first and second liquids are to be respectively remained, even though in a separated state, in the first passage (13) and the second passage (14) upon filling the aerosol content into the aerosol container (1). The remaining liquids are extremely difficult to be cleaned during a manufacturing process, and the remaining liquids such as oxidized and discolored inside respectively in the first passage (13) and the second passage (14) are ejected at the time of injection for first use, so that the remaining liquids are undesirable from a viewpoint of a product value even though the remaining liquids does not cause the hardening or defective injection of the aerosol content.

Figure 10:
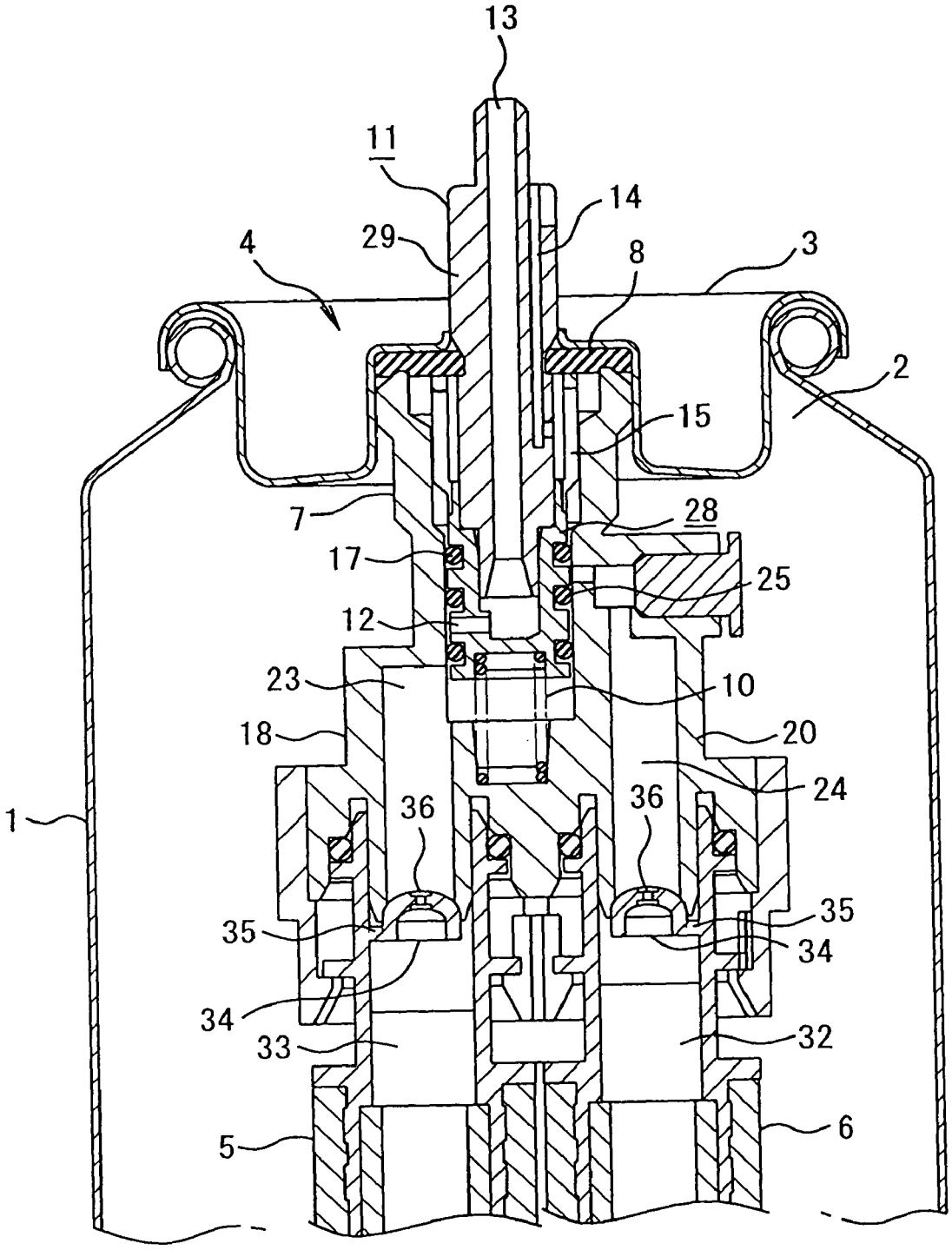
FIG. 10 is a cross-sectional view showing the sixth embodiment having a stem composed of a movable seal member and a passage member.

Therefore, in the different sixth embodiment as shown in FIG. 10, the stem (11) is composed of a movable seal member (28) arranged with the second seal member (17) and the first seal member (25), and a passage member (29) disposed with the second passage (14) and the first passage (13). The passage member (29) is set to detachable from the housing upon separated from the movable seal member (28), while the second seal member (17) is disposed at the outer circumference of the movable seal member (28) and is arranged above the second communicating opening (24) at the time that the movable seal member (28) is not pressed. The second seal member (17) is moved up to the portion lower than the second communicating opening (24) in association with the pressing of the movable seal member (28), while the first seal member (25) is connected closely, where the movable seal member (28) is pressed, to the inner circumferential surface of the housing (7) at the interval between the first communicating opening (23) and the second communicating opening (24) to intercept the communication between the first liquid and the exterior of the container, while the side opening (12) and the first liquid are communicated as connectable at the time that the movable seal member (28) is pressed.

Furthermore, with the aerosol device in which the above described movable seal member (28) and the passage member (29) are formed separately to enable the passage member (29) to be detachable from the housing (7), when filling the aerosol content, the passage member (29) is detached from the housing (7) and subsequently a filling nozzle (31) is inserted in the housing, so that both or either the first and second liquids are filled upon pressing the movable seal member (28), while when distributing the first and second liquids to the exterior of the container, the passage member (29) is inserted into the housing (7) to be communicated with the movable seal member (28).

Figure 11:
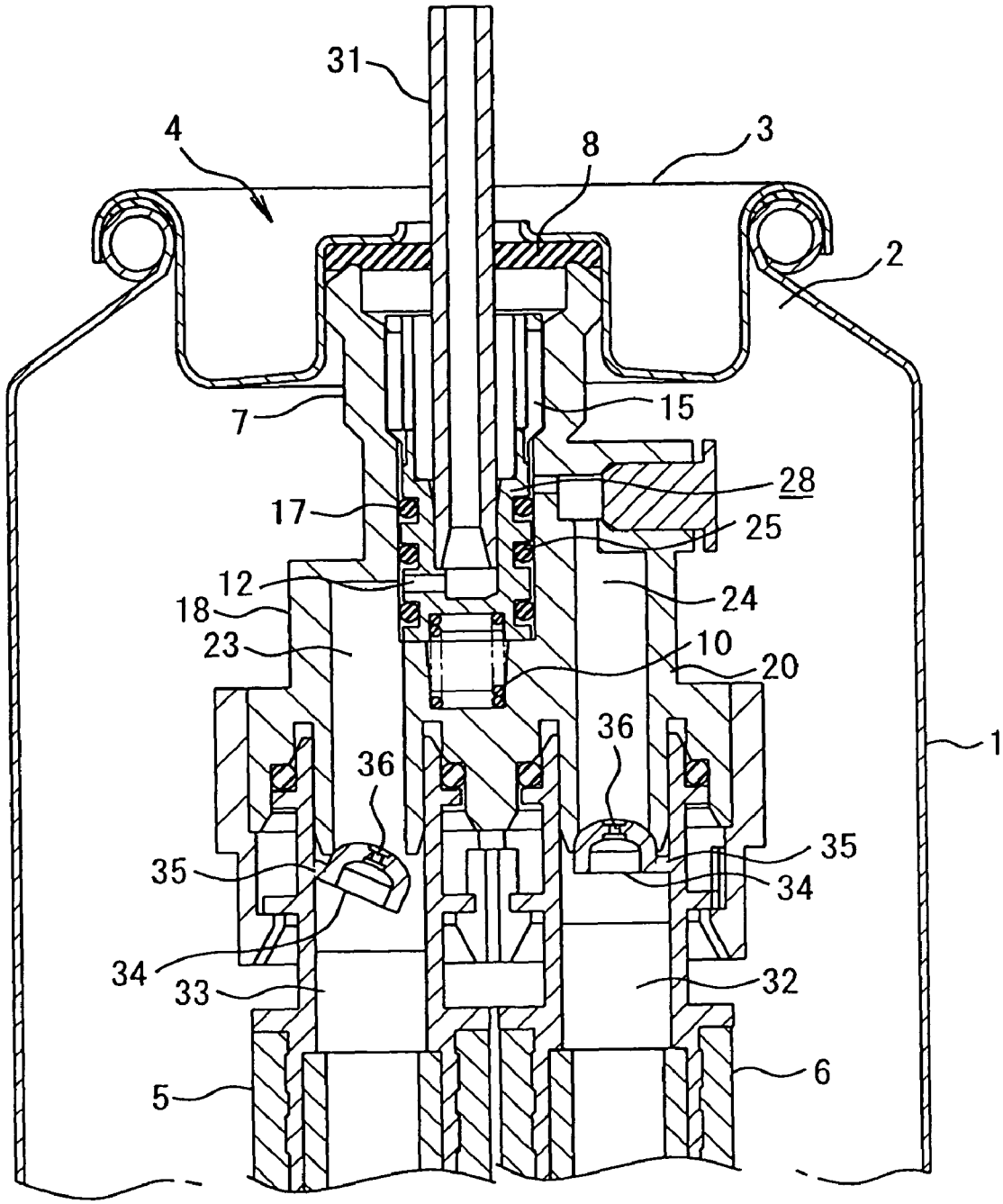
FIG. 11 is a cross-sectional view showing a state where an aerosol content is filled according to the sixth embodiment.

Upon rendering the stem (11) be composed of the movable seal member (28) and the passage member (29) as described above, the passage member (29) is detached, when filling the aerosol content, to communicate the filling nozzle (31) with the movable seal member (28) as shown in FIG. 11, thereby filling the aerosol content, so that the aerosol content does not come in contact with the second passage (14) and the first passage (13). Therefore, the discoloration conventionally caused due to the oxidation of the remaining aerosol content does not occur in the aerosol content, so that the product value can be improved. Furthermore, an example for filling the aerosol content, as shown in FIG. 11, shows a state where the aerosol content is filled in the first internal bag (5), in which the aerosol content is filled in the second internal bag (6) subsequently after the first internal bag (5) is completed to be filled. While, the aerosol content may be filled into the first internal bag (5) and the second internal bag (6) at the same time.

Further, in each of the above described embodiments, a communicating passage (32) between the second communicating opening (24) and the second liquid and a communicating passage (33) between the first communicating opening (23) and the first liquid are formed without disposed with any special valves or the like, however, in the different seventh embodiment as shown in FIG. 10 and FIG. 11, the filling open valve (34) such as released with filling pressure only when filling the second and first liquids, is arranged at each of the communicating passage (32) between the second communicating opening (24) and the second liquid and at the communicating passage (33) between the first communicating opening (23) and the first liquid. The filling open valve (34) is formed at each of the inner surface of the communicating passages (32), (33) via a hinge part (35), and is constituted as in a close contact with each valve seat of the communicating passages (32), (33) with the pressure of propellant, however, when filling the aerosol content with high pressure, the filling open valve (34) is released from the hinge part (35) to enable the aerosol content to be filled at high speed, as shown in FIG. 11.

Furthermore, such a passing small opening (36) is formed to the filling open valve (34), as passing the second and first liquids at the time of distribution of the second and first liquids. Upon formation of this passing small opening (36), the aerosol content can be prevented from excessively supplied to the second passage (14) and the first passage (13) when distributed, thereby being able to prevent the injected aerosol content from dripping or having enlarged particles.

One example for the concrete prescription of the first and second liquids is described hereinafter.

| | wt/% |
|---|---|
| (1) Permanent hair dyes of two liquids type | |
| The first liquid | |
| Dyes oxide | 0.95 |
| Germicide | 0.095 |
| Oleic acid | 4.75 |
| Polyethylene glycol | 4.75 |
| Ammonia water (28%) | 4.75 |
| Antioxidant | 0.05 |
| Chelating agent | 0.05 |
| Surface active surfactant | 2.375 |
| Purified water | 32.23 |
| The second liquid | |
| Hydrogen peroxide water (35%) | 7.195 |
| Cetyl alcohol | 0.95 |
| Surface active surfactant | 0.475 |

-continued

| | wt/% |
|---|---|
| Eidetic acid | 0.2375 |
| Phenacetin | 0.0475 |
| Purified water | 41.165 |
| Sum total | 100.0000 |

(2) Hot shaving cream

| | |
|---|---|
| The first liquid | |
| Fatty acid | 6.5 |
| Cetyl alcohol | 0.4 |
| Surface active surfactant | 0.5 |
| Liquid paraffin | 3.0 |
| 1,3-Butylene Glycol | 2.5 |
| Sorbitol | 2.5 |
| Glycerin | 6.0 |
| KOH | 1.25 |
| TEA | 0.5 |
| Potassium sulfite | 7.5 |
| Purified water | 19.35 |
| The second liquid | |
| Hydrogen peroxide water | 4.75 |
| Lecithin | 0.6 |
| Surface active surfactant | 2.15 |
| Cetyl alcohol | 0.25 |
| Purified water | 42.25 |
| Sum total | 100.00 |

(3)Adhesive agent

| | |
|---|---|
| The first liquid | |
| Epoxy resin | 35.33 |
| Calcium carbonate | 14.24 |
| Silane coupling agent | 0.40 |
| Pigment dispersion | 0.03 |
| The second liquid | |
| Fatty acid thioether | 29.78 |
| Hardening agent | 3.50 |
| Calcium carbonate | 16.00 |
| Organic acid | 0.35 |
| Silane coupling agent | 0.35 |
| Pigment dispersion | 0.02 |
| Sum total | 100.00 |

(4) Coatings

| | |
|---|---|
| The first liquid | |
| Polyester resin | 44.0 |
| Melamine resin varnish | 19.0 |
| Pigment | 30.0 |
| The second liquid | |
| Isocyanate | 7.0 |
| Sum total | 100.0 |

(5) Coatings 1

| | |
|---|---|
| The first liquid | |
| Pigment | 12.5 |
| Phosphorous acid | 5.0 |
| Xylene | 2.5 |
| Polyester resin | 25.0 |
| Ethyl acetate | 2.5 |
| Dispersing agent | 2.5 |
| The second liquid | |
| Isocyanate | 40.0 |
| Ethyl acetate | 10.0 |
| Sum total | 100.0 |

-continued

| | wt/% |
|---|---|

(6) Coating 2

| | |
|---|---|
| The first liquid | |
| Pigment | 13.0 |
| Phosphorous acid | 7.0 |
| Xylene | 4.0 |
| Polyester resin | 40.0 |
| Dispersing agent | 2.0 |
| The second liquid | |
| Isocyanate | 30.0 |
| Ethyl acetate | 4.0 |
| Sum total | 100.0 |

The invention claimed is:

1. An aerosol device for distributing two liquids comprising:

an aerosol container filled with a pressurized gas;

a first internal bag formed as easily deformed with the pressurized gas, filled with a first liquid, and arranged inside the aerosol container;

a second internal bag formed as easily deformed with the pressurized gas, filled with a second liquid different from the first liquid, and arranged inside the aerosol container;

a stem having a lower end thereof arranged at an interior of a housing;

a first passage disposed at the stem as formed up to a top end of the stem, the first passage connectable to the first internal bag;

a second passage disposed at the stem as formed up to the top end of the stem as separated from the first passage, the second passage connectable to the second internal bag;

a first seal member sealing the first internal bag and the first passage when the stem is not pressed; and a second seal member sealing communication between the second internal bag and the second passage when the stem is not pressed, wherein the second seal member is disposed on the outer circumference of the stem and situated above the communicating portion of the second liquid to the second passage to seal the communication between the second internal bag and the second passage when the stem is not pressed and, when the stem is pressed, the second seal is situated lower than the communicating portion of the second liquid to distribute the second liquid to the exterior of the container and wherein the first passage is formed from a side opening on the stem to the top end of the stem and the first seal member is disposed on the stem distal to the top end of the stem, in intimate contact with the interior of the housing, at the circumference of the side opening, so that, when the stem is not pressed, the first seal intercepts first liquid from mixing with second liquid;

wherein the first liquid and the second liquid can be distributed, without mixed in a separated state, from the stem, upon releasing the first seal member and the second seal member upon pressing and moving the stem.

2. The aerosol device for distributing two liquids according to claim 1 wherein the second seal member in communication with the interior of the housing at all times, disposed at an outer circumference of the stem, seals the communication between the second passage and the second liquid where the stem is not pressed, wherein the second liquid is communicated with the second passage in association with the pressing of the stem to be distributed to the exterior of the container, wherein the first passage is formed as penetrating from a side opening to an exterior top end of the stem, and wherein the first seal member disposed at the outer circumference of the side opening is rendered in close contact with the inner circumferential surface of the housing, where the stem is not pressed, at the interval between the communicating portion to the first liquid and the communicating portion to the second liquid to intercept the communication between the first liquid and the exterior of the container as well as to distribute the first liquid to the exterior of the container when the stem is pressed, upon connecting in a communicating manner the side opening and the first liquid.

3. The aerosol device for distributing two liquids according to claim 1, wherein the stem is composed of a movable seal member arranged with the second seal member and the first seal member, and a passage member disposed with the second passage and the first passage, wherein the passage member is detachable from the housing upon separated from the movable seal member, wherein the second seal member is disposed at the outer circumference of the movable seal member and is arranged above a second communicating opening where the movable seal member is not pressed, while being moved up to the portion lower than the second communicating opening in association with the pressing of the movable seal member, and wherein the first seal member is rendered in close contact with the inter circumferential surface of the housing, where the stem is not pressed, at the interval between a first communicating opening and the second communicating opening to intercept the communication between the first liquid and the exterior of the container as well as to communicate the side opening with the first liquid in a connectable manner when the movable seal member is pressed.

4. The aerosol device for distributing two liquids according to claim 3, wherein the passage member is, when filling an aerosol contents, detached from the housing of the aerosol device having the separately formed movable seal member and the passage member detachable from the housing to insert a filling nozzle into the housing to fill the first liquid or the second liquid upon the pressing of the movable seal member, while the passage member is inserted into the housing to distribute the first liquid and the second liquid to the exterior of the container.

5. The aerosol device for distributing two liquids according to claim 1, wherein a filling open valve opened with a filling pressure only when filling the first liquid and the second liquid, is formed at each of a communicating passage between the second communicating opening and the second liquid and the communicating passage between the first communicating opening and the first liquid, and wherein a passing small opening for passing the second liquid and the first liquid when distributing the second liquid and the first liquid, is formed at the filling open valve.

6. The aerosol device for distributing two liquids according to claim 1, wherein a top end portion of the stem has an opening surface level of the first passage and an opening surface level of the second passage different from each other, and wherein the first passage is projected upward from the opening surface of the second passage to prevent the first liquid and the second liquid respectively ejected from the first passage and the second passage from mixed with each other.

7. An aerosol device for distributing two non-identical liquids comprising:

an aerosol container filled with a pressurized gas;

a first internal bag, disposed within the aerosol container, containing a first liquid and deformable by the pressurized gas;

a second internal bag, disposed within the aerosol container, containing a second liquid and deformable by the pressurized gas;

a stem having an outer circumference, a lower end, and a top end distal the lower end, the stem situated in an interior of a housing and displaceable within the interior of the housing between not-injected and injected positions, the stem biased to the not-injected position by a spring positioned at the lower end of the stem;

a first passage disposed in the stem and open to a side opening in the stem and extending to the top end of the stem, the first passage connectable to the first internal bag;

a second passage, disposed in the stem and extending to the top end of the stem, the second passage connectable to the second internal bag through a second communicating opening in a second connecting member, the second communicating opening in turn connectable to a flow interval that is disposed between the outer circumference of the stem and an upper end of the interior of the housing;

a first seal member blocking communication between the first internal bag and the first passage when the stem is in the not-injected position; and a second seal member blocking communication between the second internal bag and the second passage when the stem is the not-injected position; wherein the second seal member is disposed on the outer circumference of the stem and positioned above the second communicating opening in the second communicating member when the stem is in the not-injected position, thereby blocking communication between the second internal bag and the flow interval and, when the stem is in the injected position, the second sealing member is positioned below the second communication opening; and wherein the first seal member is disposed on the outer circumference of the stem in close contact with the interior of the housing and, when the stem is in the not-injected position, the first seal is in a position between the side opening and the circumference of a first communication opening that is in communication with the first internal bag via a first communicating passage; whereby, when the stem is in the injected position, the first liquid and the second liquid can be injected out of the stem through the first and second passages, respectively, in a segregated state, without mixing.

* * * * *